US007543421B1

(12) United States Patent
Kelly et al.

(10) Patent No.: US 7,543,421 B1
(45) Date of Patent: Jun. 9, 2009

(54) METHODS OF SECURING AN INSTALLED CONCRETE ROOF

(76) Inventors: Matthew M. Kelly, Plaza 4, RB 12, Marina Bahía, Cataño, PR (US) 00932; Peter H. Hambly, P.O. Box 9022828, San Juan, PR (US) 00902-2828

( * ) Notice: Subject to any disclaimer, the term of this patent is extended or adjusted under 35 U.S.C. 154(b) by 138 days.

(21) Appl. No.: 11/524,592

(22) Filed: Sep. 21, 2006

(51) Int. Cl.

| | |
|---|---|
| ***E04B 1/00*** | (2006.01) |
| ***E04G 23/00*** | (2006.01) |
| ***E04B 1/38*** | (2006.01) |
| ***E04B 1/98*** | (2006.01) |
| ***E04H 9/02*** | (2006.01) |
| ***E04C 2/38*** | (2006.01) |

(52) U.S. Cl. ..... 52/745.05; 52/745.21; 52/747.1; 52/167.1; 52/167.3; 52/261; 52/263; 52/272; 52/282.3; 52/657

(58) Field of Classification Search ..... 52/745.21, 52/657, 261, 272, 275, 282.3, 656.1, 567, 52/252, 253, 167.1, 414, 745.05, 745.06, 52/167.3, 747.1, 263, 509, 136, 137
See application file for complete search history.

(56) References Cited

U.S. PATENT DOCUMENTS

| | | | | | |
|---|---|---|---|---|---|
| 1,099,953 | A * | 6/1914 | Waite | 52/236.5 |
| 1,611,096 | A * | 12/1926 | Alexander | 52/64 |
| 1,804,342 | A * | 5/1931 | Hyde | 52/253 |
| 1,851,125 | A * | 3/1932 | MacMillan | 52/236.5 |
| 1,851,137 | A * | 3/1932 | MacMillan | 52/236.5 |
| 3,378,971 | A * | 4/1968 | Singer et al. | 52/263 |
| 3,495,371 | A * | 2/1970 | Mitchell, Jr. | 52/653.1 |
| 3,703,058 | A * | 11/1972 | Klett et al. | 52/79.13 |
| 4,330,970 | A * | 5/1982 | Bonink | 52/125.4 |
| 4,736,555 | A * | 4/1988 | Nagare et al. | 52/126.6 |
| 5,174,081 | A * | 12/1992 | Reichartz | 52/263 |
| 5,474,402 | A * | 12/1995 | Wu | 403/403 |
| 5,522,184 | A * | 6/1996 | Oviedo-Reyes | 52/23 |
| 5,983,572 | A * | 11/1999 | Laboy | 52/23 |
| 6,094,878 | A * | 8/2000 | Schluter | 52/323 |
| 6,151,853 | A * | 11/2000 | Fukunaga | 52/264 |
| 7,392,620 | B1 * | 7/2008 | Watson, Jr. | 52/4 |
| 2002/0157339 | A1 * | 10/2002 | Repasky | 52/506.06 |
| 2006/0156660 | A1 * | 7/2006 | Stateson | 52/275 |

* cited by examiner

*Primary Examiner*—Richard E Chilcot, Jr.
*Assistant Examiner*—Andrew J Triggs
(74) *Attorney, Agent, or Firm*—Hoglund & Pamias, PSC; Roberto J. Rios

(57) ABSTRACT

A method of attaching an installed concrete roof is disclosed. The installed concrete roof consists of rectangular panels positioned along a grid. The concrete panels are supported by metal beams. Smaller metal panels, having a hole in each corner, are positioned over the joints formed by the corners of the rectangular panels. A hole is drilled through the concrete panels and into the supporting beams. A self-tapping screw is positioned through the hole and fixedly attaches the concrete panels to the supporting beams.

7 Claims, 5 Drawing Sheets

METHODS OF SECURING AN INSTALLED CONCRETE ROOF

FIELD OF THE INVENTION

The invention relates generally to methods of securing an installed concrete roof formed from pre-cast rectangular panels. More specifically, the invention relates to methods for fastening installed concrete panels to structural roof support beams.

BACKGROUND

Rectangular concrete panels are widely used to form roofs on industrial buildings. In typical installations, walls or columns are constructed that support horizontal metal beams. These are positioned parallel to one another and at regular intervals. The rectangular concrete panels are then placed on top of the metal beams. They are typically arranged on a grid so that the joint between two ends of the rectangular concrete panels will align along one of the metal beams. In this way, a single metal beam can support two adjacent concrete panels. After covering the roof with concrete panels, additional layers of material are added to seal and/or insulate the roof. These can include one or more layers of sand, gravel, insulation, foam, concrete, silicon paint, tar, perlite, gypsums and/or other materials.

In typical installations, the concrete panels have been insufficiently fastened or attached to the metal beams. Each has a substantial weight and this alone was used to hold them in place. In recent years, however, hurricanes have demonstrated that the weight of concrete alone can, in some instances, be insufficient to hold these panels in place. Accordingly, methods have been applied to attach these existing concrete panels to the metal beams. For example, the concrete panels may be fastened to the metal beams by drilling a hole through the metal beam and into the concrete panel. The hole may extend only partially through the concrete panel, in which case a concrete screw is used to attach the panel to the beam. Alternatively, the hole may extend completely through the panel, in which case a bolt is inserted from below and a nut from above to fasten the panel to the beam. While this method is effective, it suffers from a couple significant disadvantages. First, it requires scaffolding, ladders or other apparatus to permit a construction worker to install the fasteners. Where the building is used to shelter an industrial operation, such as a factory, that runs around the clock, it may be difficult to install these fasteners without interfering with the normal operations within the building. Second, drilling into the concrete panels generates dust. Again, depending upon the particular application, if the building is used to shelter a clean environment, such as a pharmaceutical plant, this may interfere with normal operations within the building.

SUMMARY OF THE INVENTION

It is an object of the present invention to provide a method of attaching a concrete roof to metal supporting beams.

It is an object of the present invention to minimize disruptions within the building and to minimize any dust or debris that is generated within the building.

According to one aspect of the invention, a method is employed to strengthen an existing concrete roof to resist strong winds. The existing concrete roof is made of a plurality of rectangular concrete slabs, which may be covered by one or more layers of insulation and which rest on substantially horizontal metal beams. An installer determines a length and a width of the plurality of rectangular concrete slabs. The installer identifies a corner joint where four rectangular concrete slabs meet. The installer provides a metal plate having dimensions substantially smaller than the length and width of the plurality of rectangular concrete slabs. The metal plate is rectangular and has a hole drilled proximate each corner of the metal plate. The installer positions the metal plate over the corner joint so that each of the four holes in the metal plate is positioned over a different one of the four rectangular concrete slabs forming the corner joint. The installer drills a hole through each of the four rectangular concrete slabs forming the corner joint so that the holes through the four rectangular concrete slabs are each aligned with one of the holes in the metal plate. The installer may drill four pilot holes through one of the horizontal metal beams. Each of the four pilot holes is aligned with one of the holes in the metal plate. The installer passes four screws, each through a respective one of the holes in the metal plate and one of the holes in the four rectangular slabs to engage one of the four pilot holes. Based upon the position of the corner joint and the length and width of the plurality of rectangular concrete slabs, the installer determines a position of another corner joint where four rectangular concrete slabs meet. The installer repeats these steps until all corner joints have been secured.

DETAILED DESCRIPTION

A pre-cast concrete roof is secured using a plurality of plates. The pre-cast concrete roof consists of a plurality of rectangular concrete panels. These are arranged on a grid and supported below by metal beams. The concrete panels are positioned so that their ends align along the metal beams. One plate is positioned at each joint so that it covers the corner of four adjacent concrete panels. The metal plates are pre-drilled. Using these holes as a guide, a hole is drilled through each of the four concrete panels and into the supporting metal beams. A screw is passed through each hole in the metal plate, through the corresponding hole in the corners of the concrete panels and engages the hole in the metal beams. Specifically, the hole in the metal beam is slightly smaller than the hole through the concrete panels and is sized so that the threads of the screw grip the metal beam. This operates to hold the concrete panels in place and to reinforce them against hurricane-strength winds and seismic activity. Once the first metal plate is secured, the position of the next metal plate can be determined based upon the size of the concrete panels. The next metal plate is secured in the same manner and this process is repeated until all joints have been attached. In addition, where the roof has various layers of insulation, roof covering materials and sealer, fasteners and stress plates can be added through these materials and into the concrete panels at locations other than the corner joints. These additional reinforcement fasteners and stress plates should be added as required at predetermined intervals, through the various layers of insulation, roof covering materials, and sealer, and into the concrete panels at the points of a diamond layout pattern. This operates to secure and strengthen the various layers of insulation, and roof covering materials to the existing structural panel, against strong winds and seismic activity. Finally, the roof is sealed with at least one new layer to prevent leaks.

Figure 1:
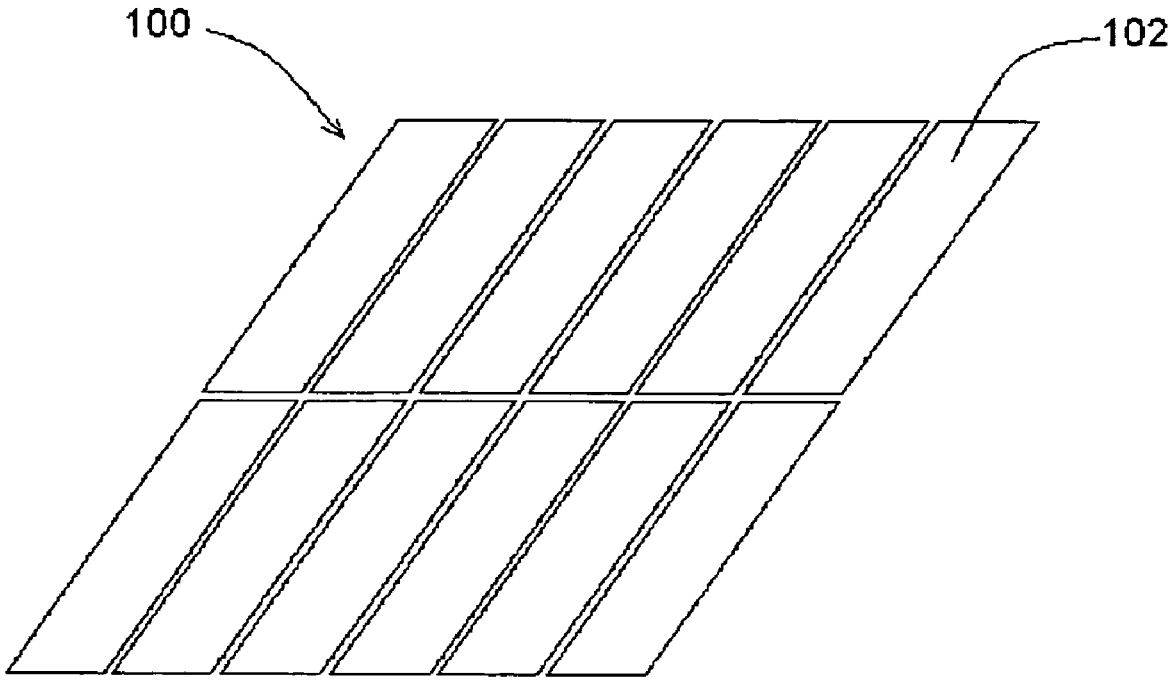
FIGURE 1 (PRIOR ART)
FIG. 1 is a perspective view of a portion of a roof having two rows and six columns of rectangular concrete panels shown without top layers of insulation and sealer.

Turning to FIG. 1, a segment of an existing roof 100 is shown. It consists of two rows and six columns of concrete panels 102. Each concrete panel 102 is rectangular. They are arranged on a grid so that a corner of one concrete panel 102 will be adjacent to the corners of three other concrete panels. The segment shown in FIG. 1, is without additional layers of insulation, roof covering materials and sealing. This is for purposes of illustration only. In an existing installation, the concrete panels and the joints between them are not visible as they are covered by such layers.

Figure 2:
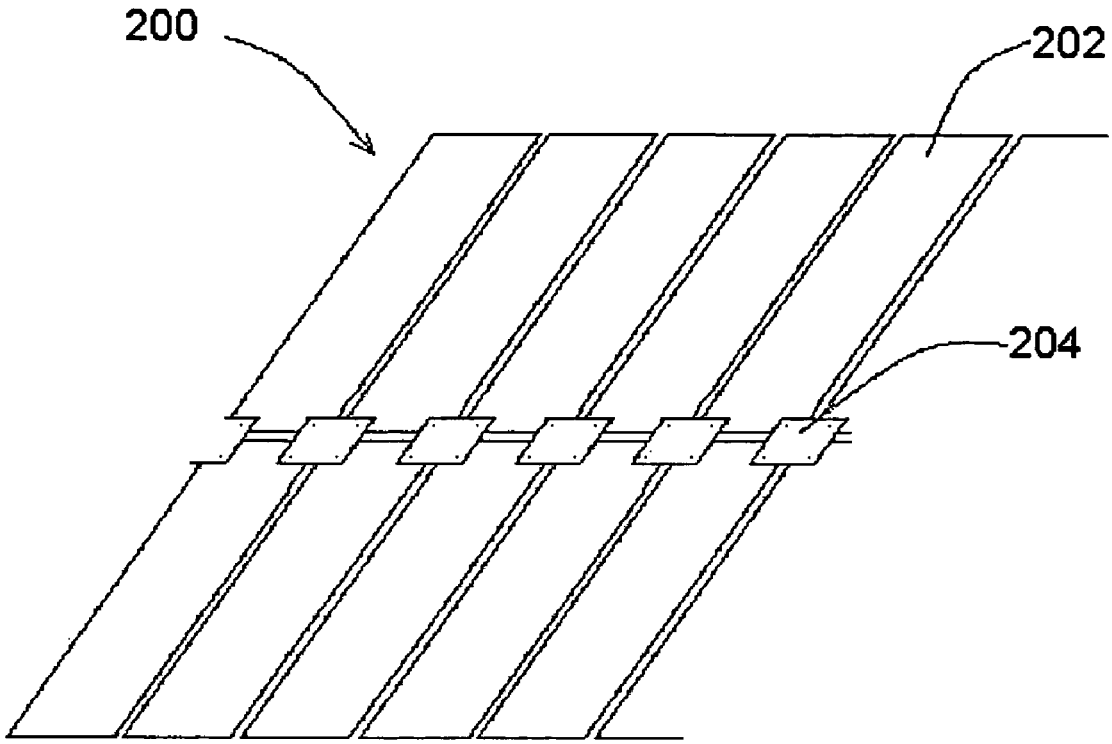
FIG. 2 is a perspective view of a portion of a roof having metal plates positioned at joints between four adjacent concrete panels.

Turning to FIG. 2, a segment of an existing roof 200 is again shown. As with the roof shown in FIG. 1, it consists of a number of existing concrete panels 202 aligned on a grid. The segment of the existing roof 200 is shown without additional layers of insulation, roof covering materials and sealing. Metal plates 204 are positioned at the corners between adjacent concrete panels. Each metal plate 204 is positioned so that it covers the corners of four adjacent concrete panels 202.

Turning to FIG. 3, a segment of an existing roof 300 is shown from a top view. It consists of a number of adjacent concrete panels 302. Again, top layers of insulation, roof covering materials, and sealer that could cover these panels are omitted from this figure. Metal plates 304 are positioned at the corners of the concrete panels 302. The metal plates 304 each have four holes 306 drilled through them. Each of these four holes is positioned proximate to a corner of the metal plates 304. The metal plates 304 are sized sufficiently large so that they cover the joint between four adjacent concrete panels 302. They are also sized so that one hole can be positioned over the corner of each of the four adjacent concrete panels 302. The metal plates 304, however, are substantially smaller than the size of the concrete panels 302. In typical applications, the concrete panels are two feet wide by seven and a half feet long, though these dimensions may vary. The metal plates are typically up to ten inches square, with the holes spaced five 3 and one half to seven inches apart.

In the preferred configuration, the holes are positioned at the corners of a rectangle within the metal plate. Along the horizontal direction (shown as B), the holes are spaced at 6 to 6.5" and the holes along the vertical direction (shown as A) are spaced at up to 5". The holes are spaced closer along the vertical direction (which is perpendicular parallel to the metal beam 308) to reduce the possibility of missing the metal beam 308 below when holes are drilled. Although the metal plates 304 are well centered on the metal beam 308 shown in FIG. 3A, in practical applications the metal beam 308 may be narrower and the metal plates 304 are not always perfectly aligned.

Figure 3A:
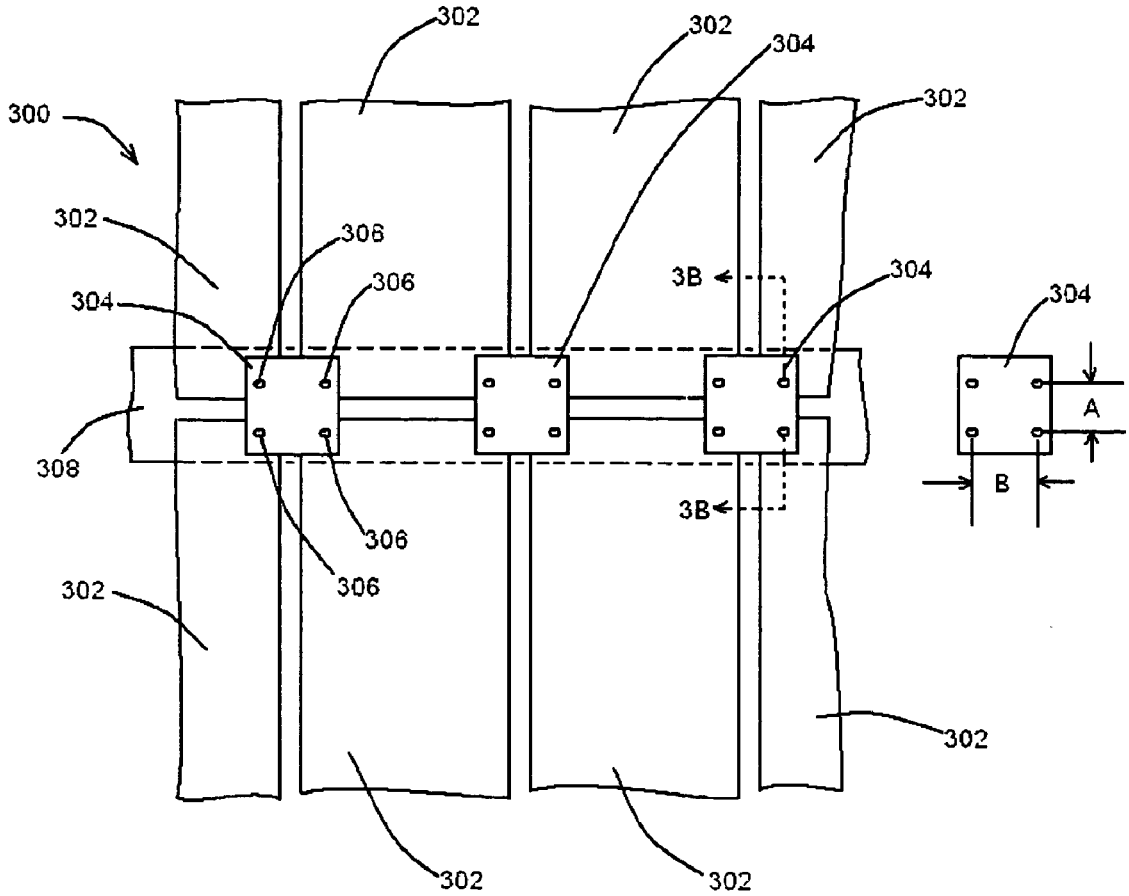
FIG. 3A is a top view of a portion of a roof having metal plates positioned on top of the roof at joints between four adjacent concrete panels and aligned with supporting beams below the concrete panels.

Specifically, as shown in FIG. 3A, a metal beam 308 runs below the concrete panels 302 to provide support. The concrete panels 302 are arranged so that their short end (typically two feet wide) rests on the metal beam 308. The metal plates 304 are positioned so that when holes are drilled through the concrete panels 302 they align with the metal beam 308. Again, by spacing the holes in the metal plates closer along the vertical direction of 3A, the possibility of missing the beam is reduced.

Figure 3B:
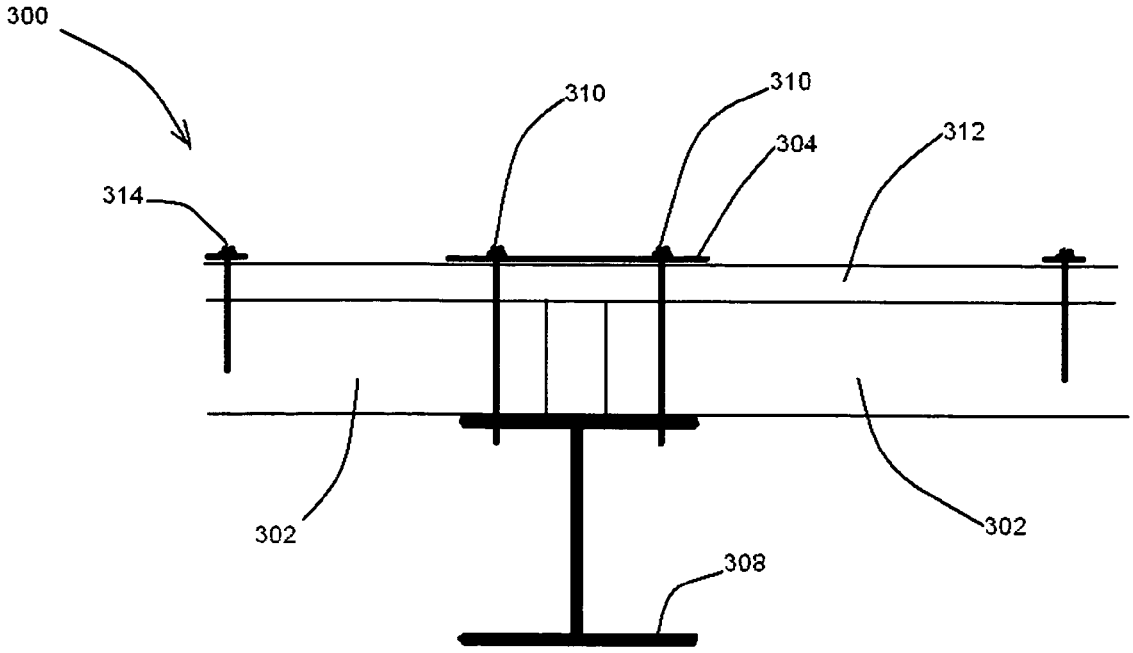
FIG. 3B is a side view of the roof shown in FIG. 3A taken along the cross section 3B-3B.

Turning to FIG. 3B, the roof 300 is shown from a side, cross-sectional view taken along section 3B-3B of FIG. 3A. Here, the concrete panels 302 are shown resting on the metal beam 308. Screws 310 (which were not shown in FIG. 3A) are passed through the metal plate 304, through the holes in the concrete panels 302 and engage the top of metal beam 308.

Although metal beam 308 is shown as an "I" beam, the same method can be used to fasten to other underlying structures, including flanged joists, C channel and Z bar. The specific size of the screws or other fasteners as well as the size of any pilot hole through the metal beam 308 will vary depending upon the particular application. These are chosen to conform with the existing structure. Similarly, the gauge of the metal plate 304 will be selected to meet the requirements of the particular application.

Although not shown in FIG. 3A, the top layers of insulation, roof covering materials, and sealer are shown as layers 312 in FIG. 3B. In an actual installation, these will cover and seal the joints between adjacent concrete panels 302. One difficulty these layers 312 present is that they cover the actual position of the joints from view. Consequently, when installing the metal plates 304 on an actual roof, the position of the joints must be determined using a non-visual method. This can be accomplished by first determining the size of the concrete panels. To do so, an installer can enter the interior of the building where the seams along the length of adjacent concrete panels would be visible and permit a measurement. In addition, the distance between adjacent supporting beams could be readily determined. With this information, the installer can begin at the edge of the roof and determine the position of the first corner joint. A drill can be used to make a pilot hole to confirm the exact location. The drill will pass easily when a gap between panels is found. Once the first metal plate is properly positioned, it is used as a reference for placement of the other metal plates. A template may be used that is the same size as a concrete panel.

In addition to the screws through the metal plates, additional screws and stress plate can be used to better secure the layers 312. A hole can be drilled through the layers 312 and into the concrete panels 302. A screw 314 is then driven into this hole using a clutched fastener driver to provide additional resistance to the removal of these layers 312. Preferably, these screws with stress plates 314 would be positioned in a diamond pattern in a concentration determined by wind classification.

Figure 4:
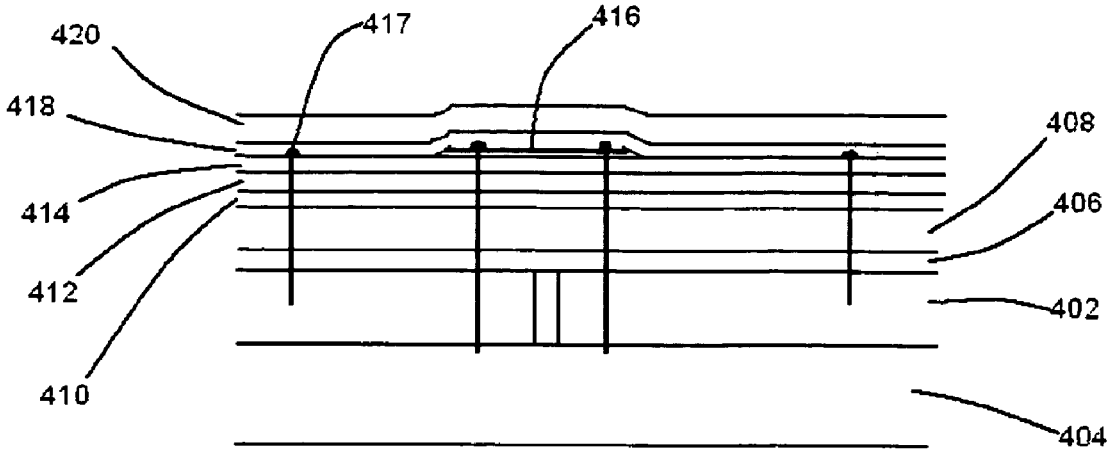
FIG. 4 is a side view of a roof showing layers of insulation, roof covering materials, and sealer after securing concrete panels with metal plates.

Turning to FIG. 4, the specific layers of a typical installation are further detailed. A typical installation will include concrete panels 402 resting on metal support beams 404. A first layer of roof covering material or sealer 406 covers the concrete panels 402. Above this, a layer of insulation 408 is typically 1"-2" thick. Above this, a separation board 410 and additional one or two layers of roof ply 412 further seals the roof.

Before installation of the metal plates, the loose gravel 412 is removed. In addition, a commercially available base sheet may be applied. This material is commercially available by, for example, Johns Manville Corporation, as DynaBase. On top of this, the metal plates 416 are installed along with screws and stress plates 417 through the existing layers to better secure them. On top of the metal plates, another base sheet 418 is applied and then a cap sheet 420 to completely seal and secure the roof.

In some applications, the layers of insulation may be particularly thick. To reduce the length of screws required to attach the metal plates, such applications may prefer removal of the insulation or other layers prior to securing the metal plates.

As an alternative to providing rectangular or square plates, a long metal strip could be substituted. The metal strip would be aligned with an underlying support beam. As another alternative, smaller individual plates could be used. Each screw used to fasten a concrete panel to a support beam would have a small metal plate.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

We claim:

1. A method of reinforcing the attachment of an existing concrete roof to resist strong winds and seismic activity where the existing concrete roof is made of a plurality of rectangular concrete slabs resting on substantially horizontal metal beams, the method comprising the steps of:

(a) determining a length and a width of the plurality of rectangular concrete slabs;

(b) identifying a corner joint where four rectangular concrete slabs meet;

(c) providing a metal plate having dimensions substantially smaller than the length and width of the plurality of rectangular concrete slabs, wherein the metal plate is rectangular and has a hole drilled proximate each corner of the metal plate;

(d) positioning the metal plate over the corner joint so that each of the four holes in the metal plate is positioned over a different one of the four rectangular concrete slabs forming the corner joint;

(e) drilling a hole through each of the four rectangular concrete slabs forming the corner joint so that the holes through the four rectangular concrete slabs are each aligned with one of the holes in the metal plate;

(f) drilling four pilot holes through one of the horizontal metal beams wherein each of the four pilot holes are aligned with one of the holes in the metal plate;

(g) passing four screws, each through a respective one of the holes in the metal plate and one of the holes in the four rectangular slabs to engage one of the four pilot holes;

(h) based upon the position of the corner joint and the length and width of the plurality of rectangular concrete slabs, determining a position of another corner joint where four rectangular concrete slabs meet; and (i) repeating steps (c) through (g) until all corner joints have been secured.

2. The method of claim 1, wherein the metal plate is substantially square and wherein the holes in the metal plate are positioned at the corners of a rectangle having dimensions smaller than those of the metal plate.

3. The method of claim 2, further comprising the step of securing a plurality of screws into the concrete slabs in addition to the screws that pass through the holes in the metal plates.

4. The method of claim 3, wherein in the step of the drilling four pilot holes through one of the horizontal metal beams, self-drilling screws drill the pilot holes.

5. A method of securing installed, prefabricated concrete roof panels to a metal beam support structure, comprising the steps of:

identifying a building having a roof constructed of prefabricated concrete panels supported by a metal beam structure, wherein the panels are rectangular and arranged on a regular grid, and wherein narrow ends of adjacent concrete panels are supported by a single beam in the metal beam structure, and wherein the prefabricated concrete panels are covered by a layer of insulation;

identifying a corner joint between four adjacent prefabricated concrete panels;

positioning a metal plate over the corner joint, wherein the metal plate defines a set of four holes, and wherein each of the four holes is positioned over a respective one of the four adjacent prefabricated concrete panels forming the corner joint;

drilling a hole through each of the four adjacent prefabricated concrete panels and into a first beam; and positioning a fastener through the metal plate and through each of the holes through the four adjacent concrete panels, wherein each fastener engages the first beam.

6. The method of claim 5, wherein step of identifying a corner joint comprises drilling a hole through the layer of insulation to find a gap between the four adjacent concrete panels forming the corner joint.

7. The method of claim 6, wherein, in the step of positioning the metal plate, the metal plate has the four holes arranged at the corners of a rectangle so that the holes are more closely spaced in a first direction than in a second direction, and wherein the metal plate is positioned so that the first direction is perpendicular to the single beam.

* * * * *